US007205949B2

(12) United States Patent
Turner

(10) Patent No.: US 7,205,949 B2
(45) Date of Patent: Apr. 17, 2007

(54) DUAL REFLECTOR ANTENNA AND ASSOCIATED METHODS

(75) Inventor: Gregory M. Turner, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 11/140,836

(22) Filed: May 31, 2005

(65) Prior Publication Data

US 2006/0267851 A1 Nov. 30, 2006

(51) Int. Cl.
*H01Q 13/00* (2006.01)

(52) U.S. Cl. ..... 343/781 P; 343/781 CA; 343/779; 343/DIG. 2

(58) Field of Classification Search ..... 343/781 CA, 343/781 R, 781 P, 779, 836, 837, DIG. 2
See application file for complete search history.

(56) References Cited

U.S. PATENT DOCUMENTS

| | | | | |
|---|---|---|---|---|
| 3,953,858 A | | 4/1976 | Ohm | 343/779 |
| 4,203,105 A | | 5/1980 | Dragone et al. | 343/781 |
| 4,298,877 A | * | 11/1981 | Sletten | 343/781 CA |
| 4,355,314 A | | 10/1982 | Ohm | 343/779 |
| 4,364,052 A | | 12/1982 | Ohm | 343/781 |
| 4,535,338 A | | 8/1985 | Ohm | 343/781 |
| 4,591,866 A | | 5/1986 | Mizuguchi et al. | 343/781 P |
| 4,618,867 A | * | 10/1986 | Gans | 343/781 P |
| 5,790,077 A | * | 8/1998 | Luh et al. | 343/781 P |
| 5,859,619 A | | 1/1999 | Wu et al. | 343/781 CA |
| 6,150,991 A | | 11/2000 | Hulderman | 343/781 CA |
| 6,198,455 B1 | * | 3/2001 | Luh | 343/781 CA |
| 6,211,835 B1 | | 4/2001 | Peebles et al. | 343/781 P |
| 6,215,452 B1 | | 4/2001 | Chandler et al. | 343/781 P |
| 6,236,375 B1 | | 5/2001 | Chandler et al. | 343/781 P |
| 6,342,865 B1 | * | 1/2002 | Chandler et al. | 343/781 CA |
| 6,424,310 B1 | | 7/2002 | Broas et al. | 343/781 P |
| 6,424,312 B2 | | 7/2002 | Mangenot et al. | 343/840 |
| 6,580,399 B1 | * | 6/2003 | Ballinger et al. | 343/781 P |
| 2004/0008148 A1 | | 1/2004 | Lyerly et al. | 343/781 P |

* cited by examiner

*Primary Examiner*—Tho Phan
(74) *Attorney, Agent, or Firm*—Allen, Dyer, Doppelt, Milbrath & Gilchrist, P.A.

(57) ABSTRACT

An antenna system includes an antenna feed aligned with a subreflector and a main reflector. The subreflector has a concave surface defining a vertex. A main reflector having a concave surface is aligned with the subreflector to define an antenna focal area at the vertex of the subreflector. The antenna feed may be a phased array or fixed antenna feed. The antenna system may further include a controller cooperating with the phased array antenna feed for beamsteering or beamforming. The controller may cooperate with the phased array antenna feed to define and steer multiple beams, at different frequencies, for example.

28 Claims, 6 Drawing Sheets

DUAL REFLECTOR ANTENNA AND ASSOCIATED METHODS

FIELD OF THE INVENTION

The invention relates to the field of antennas, and, more particularly, to offset reflector antennas and related methods.

BACKGROUND OF THE INVENTION

An antenna is used to capture electromagnetic energy when operating in a receive mode, and to radiate such energy when in a transmitting mode. Accordingly, an antenna is a typical part of a communication system that also includes a transmitter and receiver, for example. To increase the antenna aperture, one or more reflectors may be arranged adjacent an antenna feed. An array feed including multiple elements may be used with such a reflector system to provide multiple beams or electronic scan capability.

U.S. Pat. No. 6,236,375 to Chandler et al. discloses a reflector antenna including a feed array, a subreflector, and a main reflector, which are oriented to define an offset Gregorian antenna geometry. The antenna feed includes a plurality of separate feeds that are aligned on a predetermined contour and connected to a feed network to produce a plurality of composite illumination beams. The subreflector and main reflector are positioned so that the focal point of the main reflector is approximately coincident with the focal point associated with the convex side of the subreflector. The feed is positioned in proximity of the focal point associated with the concave side of the subreflector.

U.S. Pat. No. 4,203,105 to Dragone et al. discloses a feed array aligned with a confocal reflector system that includes a subreflector aligned with a main reflector at a coincident focal point. U.S. Patent Application Publication No. 2004/0008148 to Lyerly et al. also discloses a Gregorian antenna reflector system including a feed array, a subreflector, a main reflector, and at least one other subreflector.

U.S. Pat. No. 6,424,310 to Broas et al. discloses a feed array, a subreflector, and a main reflector, which are oriented to define a dual offset Cassegrain antenna geometry. The coincidental focal points of the main reflector and the subreflector are located on the convex side of the subreflector.

U.S. Pat. No. 6,215,452 to Chandler et al. discloses a feed array, a subreflector, and a main reflector, which are oriented to define a front-fed dual reflector antenna geometry. The coincident focal points of the main reflector and the subreflector are located on the concave side of the subreflector.

U.S. Pat. No. 6,211,835 to Peebles et al. discloses a feed array, a subreflector, and a main reflector, which are oriented to define a side-fed dual reflector antenna geometry. The coincidental focal points of the main reflector and the subreflector are located on the convex side of the subreflector.

A prior art antenna system 20 is now described with reference to FIG. 1. This antenna system 20 includes a feed array 22 that illuminates a subreflector 23 that, in turn, reflects the energy to a main reflector 21. The subreflector 23 is aligned with the main reflector 21 at a coincident focal point 24 in what is termed a near field Gregorian configuration. Unfortunately, such a system 20 may be mechanically complex due to the relatively large displacement required between the main reflector 21 and the subreflector 23.

There are two fundamental approaches for an array fed multiple beam or electronically scanned antenna system.

The first is the Gregorian configuration as disclosed in U.S. Pat. Nos. 6,236,375 and 4,203,105. The second is a focused system like the Cassegrain systems of U.S. Pat. Nos. 6,424,310; 6,215,452; and 6,211,835.

The focused system uses a focused antenna where the reflector(s) serves to focus the energy incident on the main reflector at a single point. Most reflector antennas are focused systems that use a single feed aligned to the focal point of the reflector or reflector system. When an array feed is used with a focused reflector system, feed array elements that are not on the focal point produce beams that have significant phase error, since they are not focused, resulting in distorted beam shapes and reduced beam gain. Multiple elements can be combined to overcome some of these effects, but the fundamental effect of pattern degradation as the beams are steered away from broadside is still present.

Another technique is to use a very long focal length to reduce the defocusing effects with scan. In this technique, the feed element displacement from the focal point required to scan the beam is proportional to the focal length. As a result, for a given beam displacement range the feeds have to increase in size and number of elements as the focal length grows. Another fundamental aspect of a focused system is that the beams are scanned primarily by using different feed elements so that any particular beam may only use a small fraction of the feed. Consequently, such a focused system has a low feed utilization.

The Gregorian or confocal (focal point of main and subreflector are coincident) dual reflector arrangement is distinctly different from the focused reflector systems. The optics of a Gregorian system concentrate the energy incident on the main reflector to a smaller aperture rather than a focal point. This property is sometimes referred to as aperture magnification since a scaled replica of the fields incident on the main reflector are produced at the feed. As a result, the Gregorian system may overcome many of the shortcomings of a conventional focused system because there is reduced beam distortion and most of the feed is utilized.

The drawback with a Gregorian system is the large and cumbersome geometries that are required. The magnification is proportional to the ratio of the focal lengths. Consequently, to use a small feed and produce a large aperture with minimal blockage, a relatively large subreflector with significant separation from the main reflector is required.

SUMMARY OF THE INVENTION

In view of the foregoing background, it is therefore an object of the invention to provide an antenna system and related method that can produce multiple beams or electronically scanned beam(s) with low beam distortion and high feed utilization in a compact package.

This and other objects, features, and advantages in accordance with the invention are provided by an antenna system wherein the subreflector is positioned adjacent the focal area of the main reflector. The antenna system includes an antenna feed, and a subreflector aligned with the antenna feed. The subreflector may have a concave surface defining a vertex. The main reflector may have a parabolic or concave surface aligned with the subreflector to define an antenna focal point or area at the vertex of the subreflector. Accordingly, the antenna system provides the aperture magnification properties of the array fed Gregorian reflector configuration, but is relatively compact. The antenna focal point or area may be center fed, offset center fed, or implemented in an offset configuration to reduce blockage.

The antenna feed may comprise an array feed with a beam forming network configured to provide multiple beams. Alternately, the antenna feed may comprise a phased array antenna feed with adjustable phase at each feed element. The antenna system may further comprise a controller cooperating with the phased array antenna feed for beamsteering, such as to define and steer multiple beams. The controller may further cooperate with the phased array antenna feed to define and steer multiple beams at different frequencies.

The concave surfaces of the main reflector and subreflector may each have a parabolic shape in some embodiments. In other embodiments, the concave surfaces of the main reflector and subreflector may be flat in one dimension or have a partial cylindrical shape.

The antenna system in accordance with the invention may have particular applicability to space-borne communications. Accordingly, another aspect of the invention is directed to a spacecraft comprising a space-borne platform to carry the antenna system.

A method aspect of the invention is directed to making the antenna system. The method may include aligning a subreflector with an antenna feed in which the subreflector has a concave surface defining a vertex. The method may further include aligning a main reflector, which has a concave surface, with the subreflector to define a focal point at the vertex of the subreflector.

DETAILED DESCRIPTION OF THE PREFERRED EMBODIMENTS

The invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternate embodiments.

Figure 1:
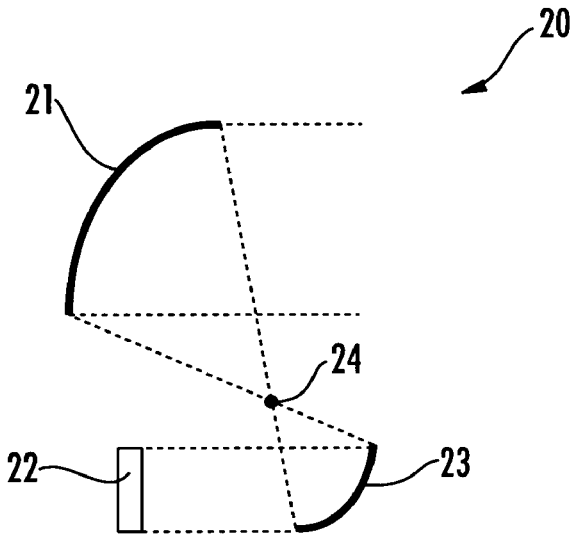
FIG. 1 (PRIOR ART)
FIG. 1 is a schematic diagram of a prior art near field Gregorian antenna configuration.

The antenna system 30 according to the invention is now described with reference to FIGS. 2 and 3. The antenna system 30 includes an antenna feed 32. A subreflector 33 is aligned with the antenna feed 32 and has a concave surface 35 defining a vertex 34. A main reflector 31 having a concave surface 36 is aligned with the subreflector 33 to define an offset antenna focal area adjacent the vertex 34 of the subreflector 33 as shown by rays 38. Accordingly, the antenna system 30 is relatively compact in comparison to the conventional near field Gregorian antenna configuration 20 as shown in FIG. 1 and described above.

The antenna system 30 has characteristics similar to the Gregorian antenna configuration 20 by providing reduced distortion, aperture magnification, and full feed utilization. The antenna system 30 achieves this is in a more compact geometry by manipulating the optics associated with the subreflector 33. The vertex 34 of the subreflector 33 is placed at the main reflector 31 focal point instead of having coincident focal points, and the array feed phase distribution is manipulated to produce a feed/subreflector combination equivalent to the Gregorian antenna configuration 20 in performance. The antenna system 30 physically differs from the Gregorian antenna configuration 20 by having a non-confocal configuration. For example, a smaller displacement between the main reflector 31 and the subreflector 33, and by using a smaller subreflector 33 than an equivalent Gregorian antenna configuration 20.

Figure 2:
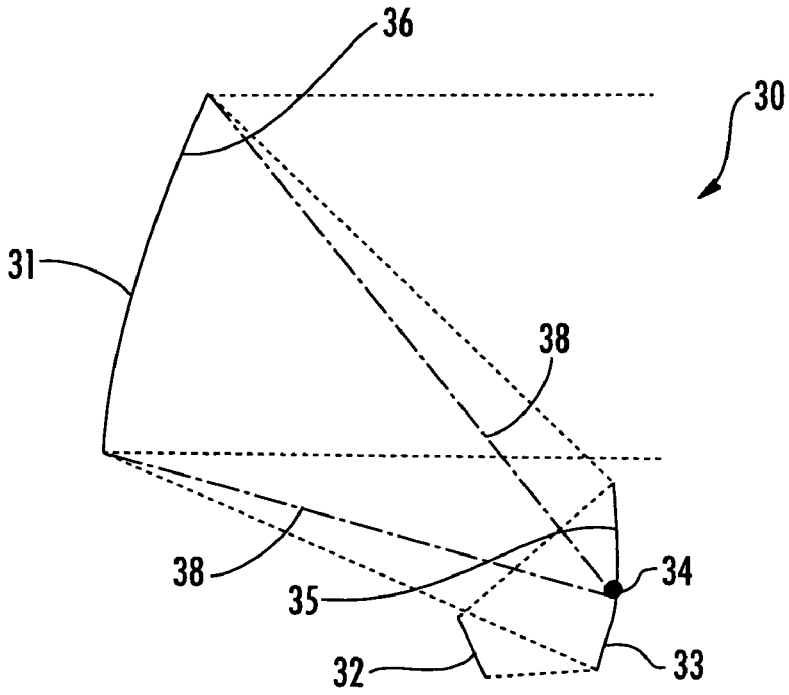
FIG. 2 is a schematic diagram of a first embodiment of the antenna system according to the invention.
Figure 3:
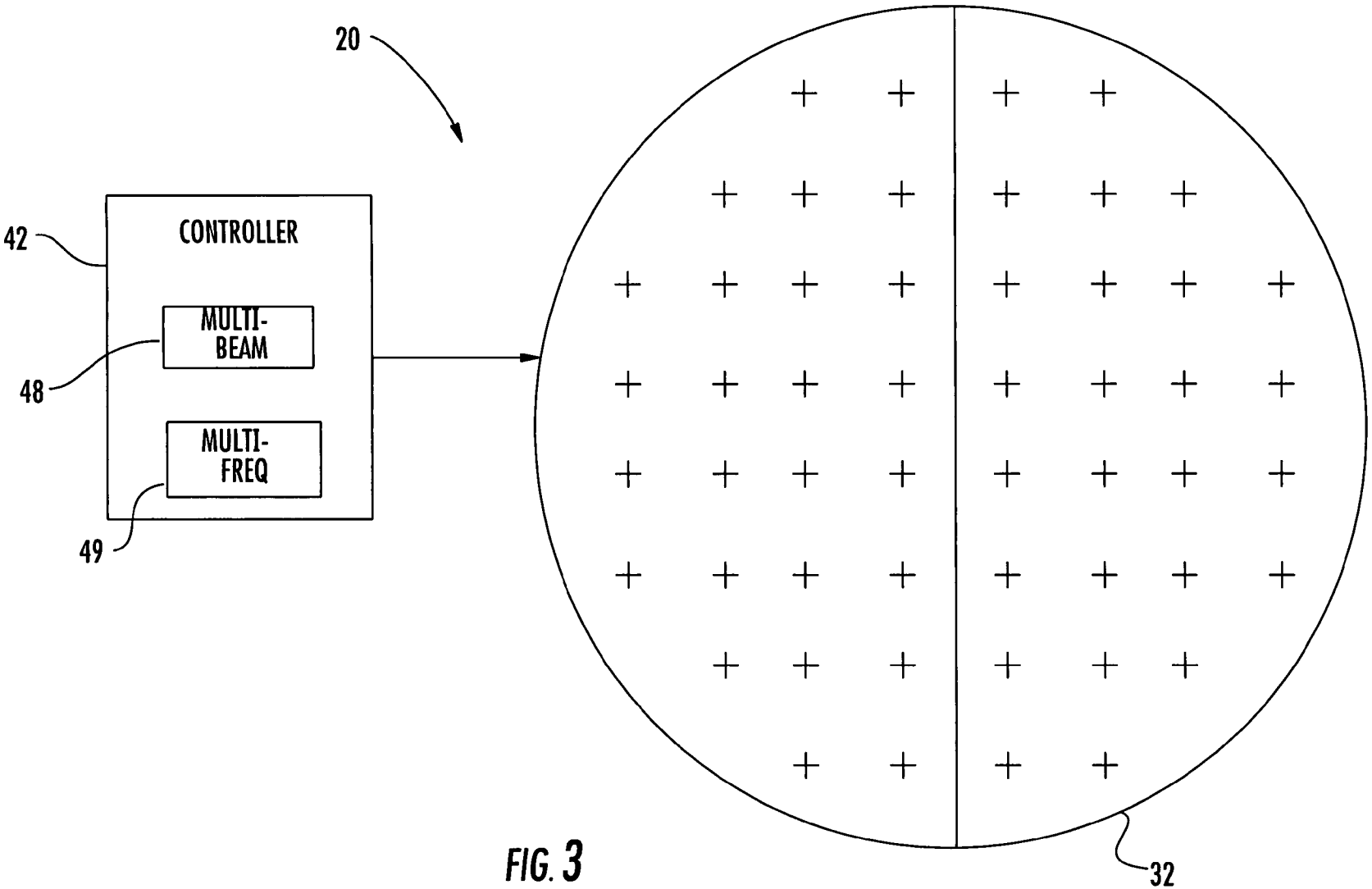
FIG. 3 is a more detailed schematic diagram of the antenna feed shown in FIG. 2.

The antenna feed 32 may comprise a phased array antenna feed, for example, as schematically shown in FIG. 2. The antenna system 30 also illustratively comprises a controller 42 cooperating with the phased array antenna feed 32 for beamsteering. The controller 42 may include multi-beam circuitry 48 cooperating with the phased array antenna feed 32 to define and steer multiple beams. The controller 42 may further include multi-frequency circuitry 49 also cooperating with the phased array antenna feed 32 to define and steer multiple beams at different frequencies. Of course, in other embodiments, an antenna feed other than a phased array antenna feed may be used as will be appreciated by those skilled in the art. For instance, the antenna feed 32 may be in the form of a fixed array and beamformer that provides multiple beams.

Figure 4:
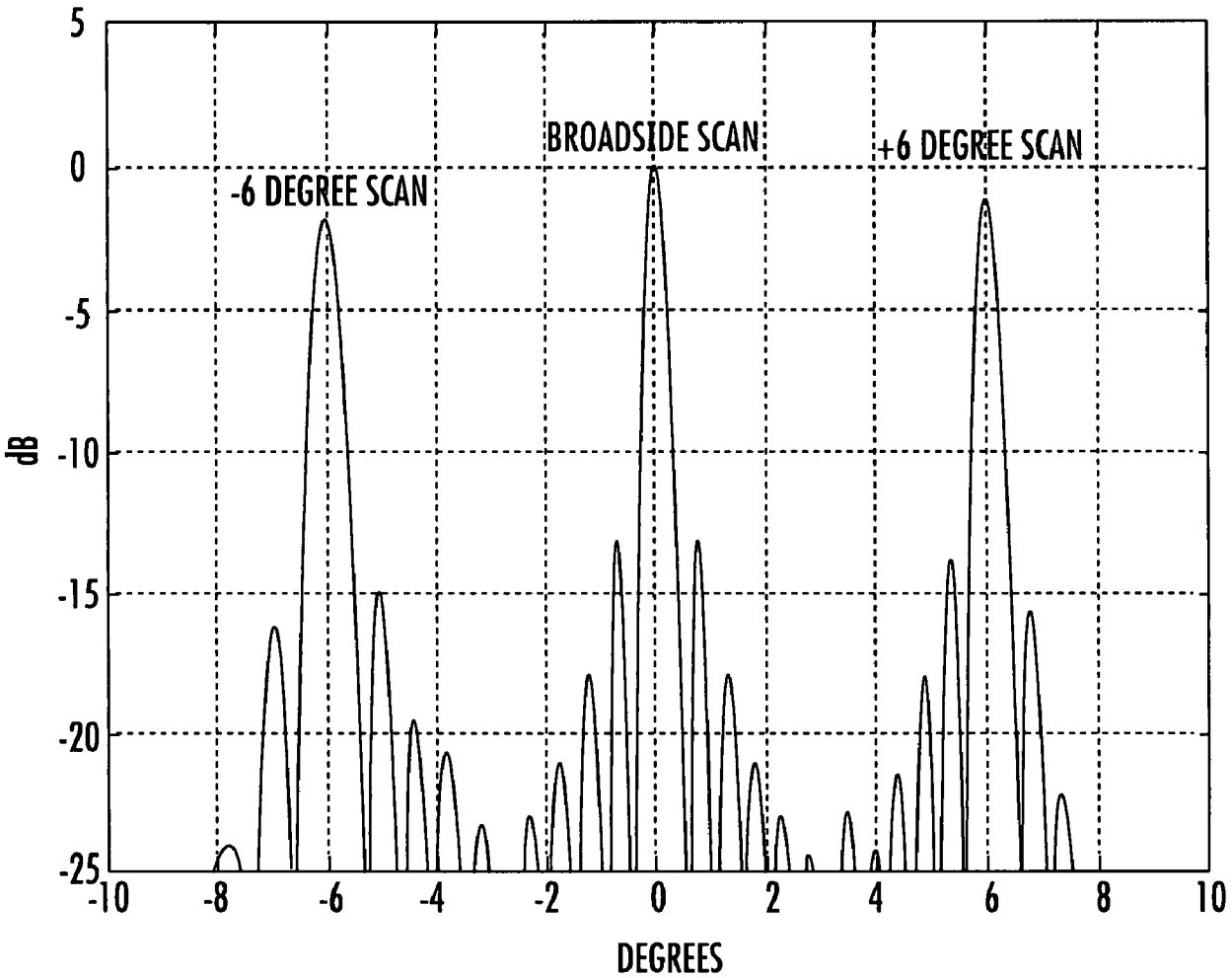
FIG. 4 is an example of composite steered patterns produced by the antenna system of FIG. 2.

An example of composite steered patterns is shown in FIG. 4. Composite steered patterns are formed by adjustment of the phase excitation at individual elements and combining the element outputs. The amplitude excitation is held constant across all elements. Three patterns are illustratively shown at 0 degrees, and plus/minus 6 degrees.

The concave surface 35 of the subreflector 33 may have a parabolic shape in some embodiments, that is, a three-dimensional concave shape. For these embodiments, the concave surface 36 of the main reflector 31 may also have a parabolic shape. In these embodiments, the focal area is a focal point and the vertex is a vertex point as will be appreciated by those skilled in the art.

In other embodiments, for example a two-dimensional configuration, the concave surface 35 of the subreflector 33 may be flat in one dimension or have a partial cylindrical shape and the concave surface 36 of the main reflector 31 may have a partial cylindrical shape.

Figure 6:
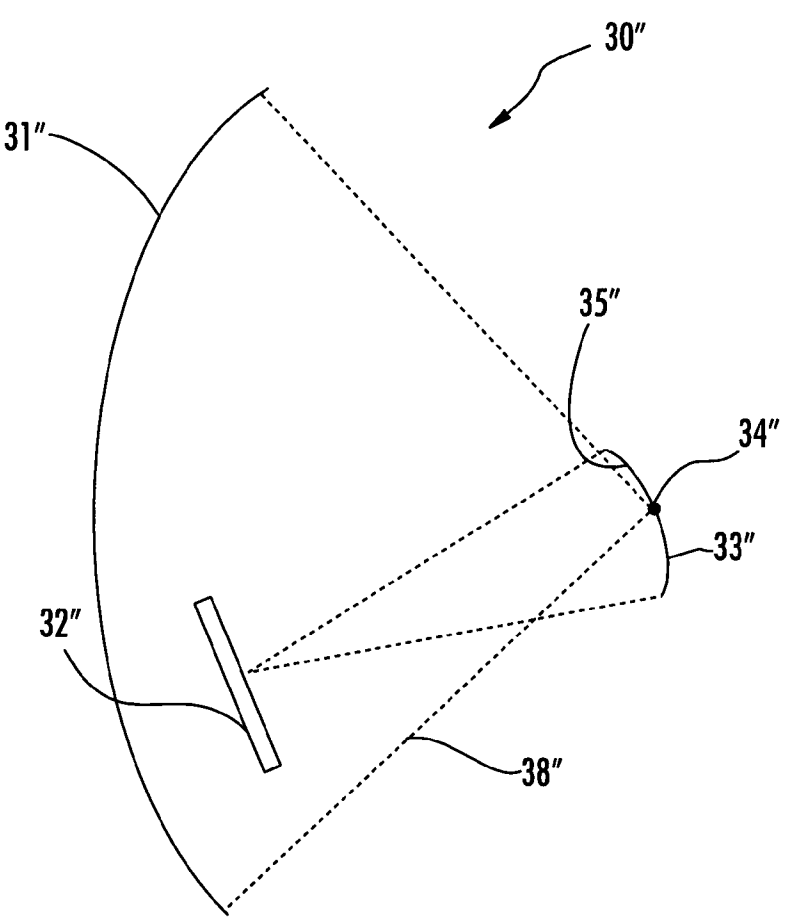
FIG. 6 is schematic diagram of a third embodiment of the antenna system according to the invention.
Figure 5:
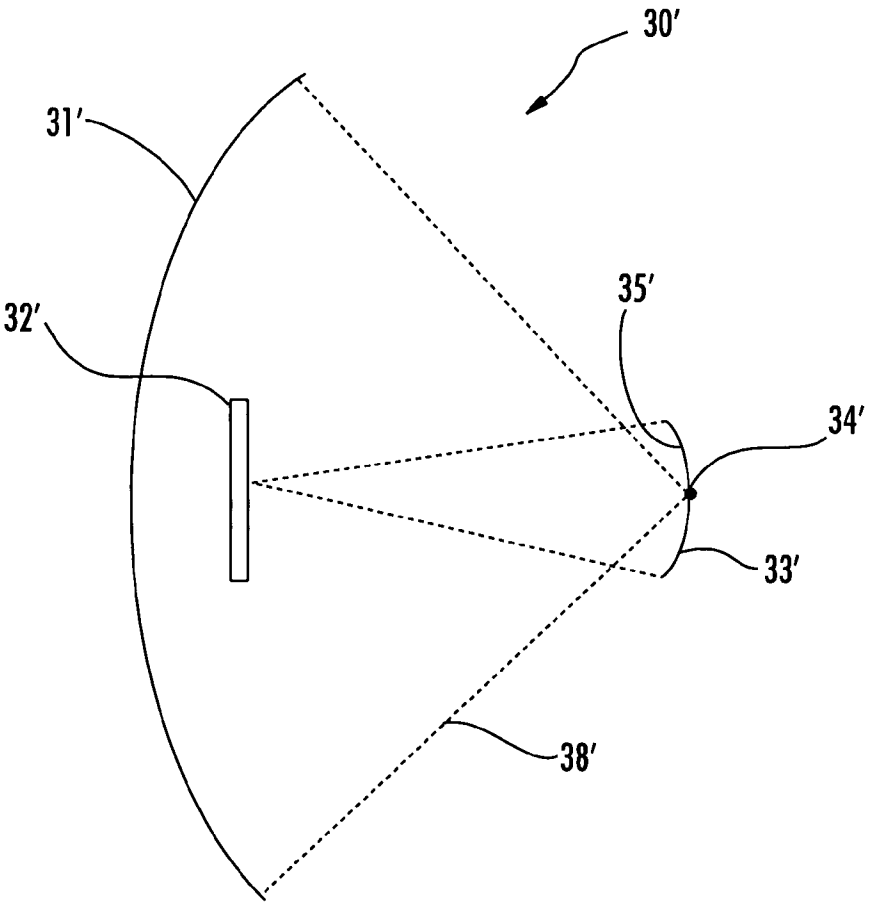
FIG. 5 is a schematic diagram of a second embodiment of the antenna system according to the invention.

The antenna system may also be realized in alternate configurations 30' and 30" as illustrated in FIGS. 5 and 6, respectively. The antenna system 30' of FIG. 5 is a center fed configuration, and the antenna system 30" of FIG. 6 is an offset center fed configuration. Those other elements not specifically described are indicated by prime and double prime notation, and require no further discussion herein.

Figure 7:
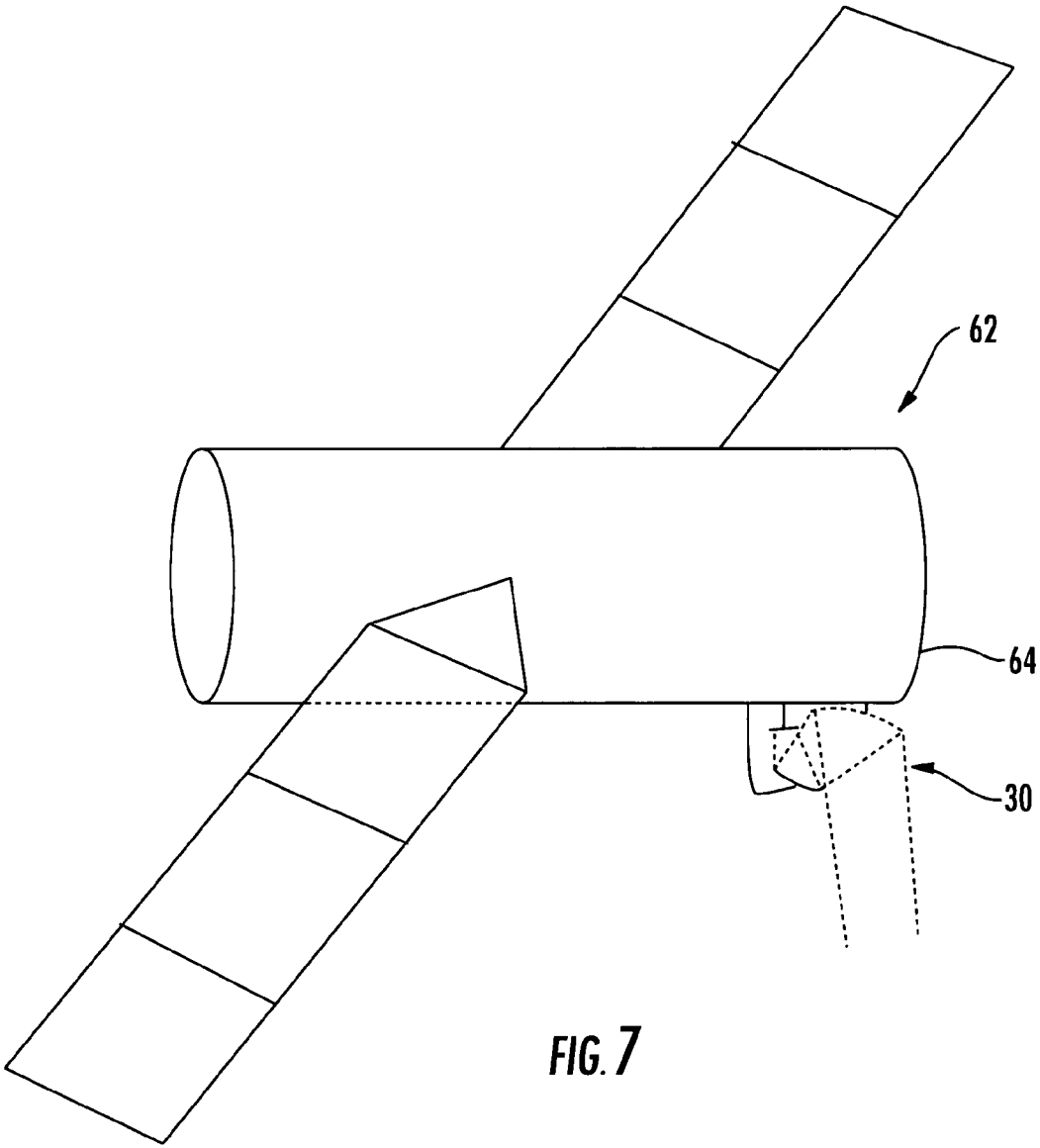
FIG. 7 is a schematic of a spacecraft including the antenna system shown in FIG. 2.

Referring now additionally to FIG. 7, another aspect of the invention relates to a spacecraft 62 comprising a space-borne platform 64 to carry the antenna system 30. Such a space-borne antenna system 30 may be used for communications or radar applications as will be appreciated by those skilled in the art. Of course, the antenna system 30 may also be used in air-borne or terrestrial applications as well.

Figure 8:
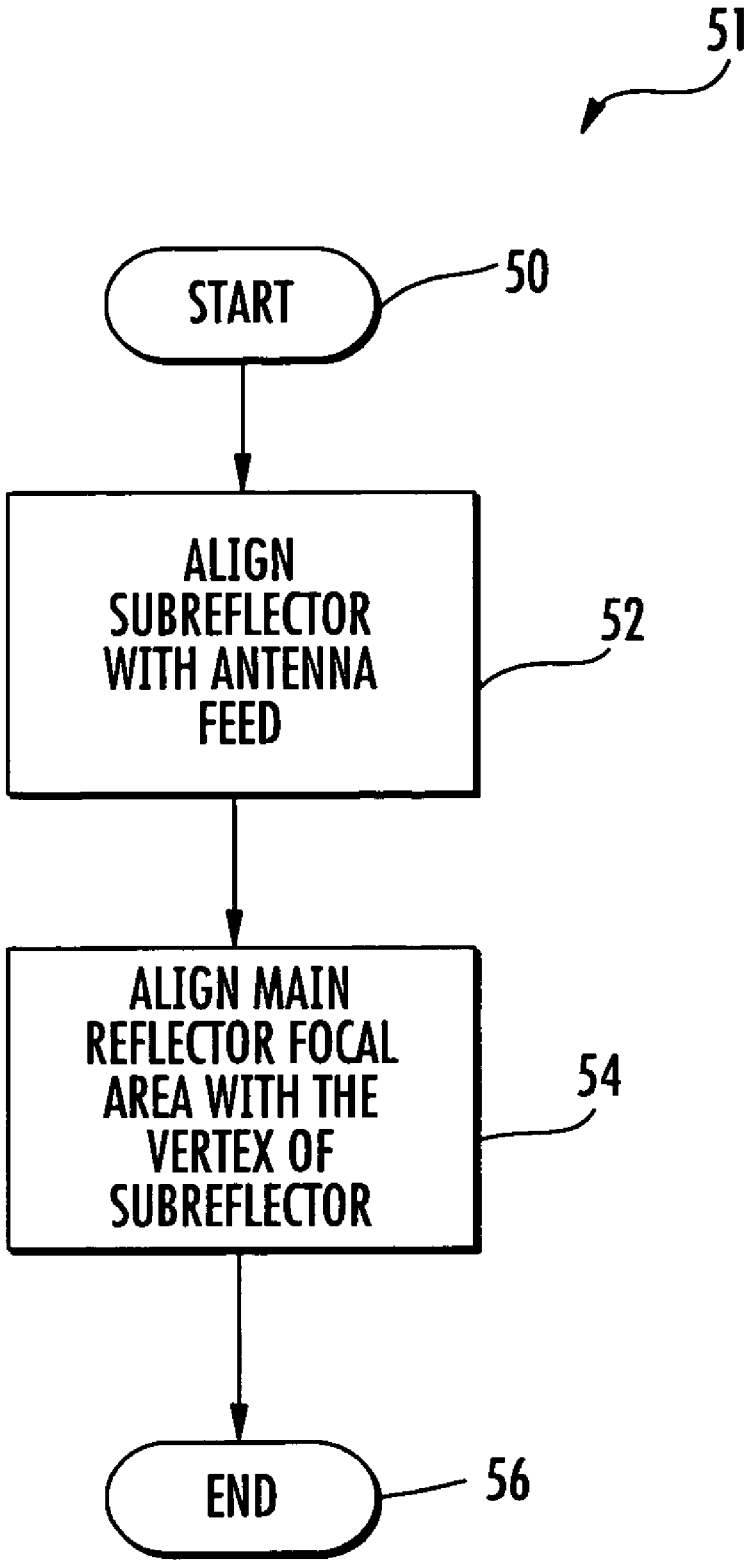
FIG. 8 is a flowchart illustrating a method according to the invention.

A method aspect of the invention for making the antenna system 30 as now explained with reference to the flow chart 51 shown in FIG. 8. The method starts at Block 50 and may include aligning a subreflector with an antenna feed, at Block 52, in which the subreflector has a concave surface defining a vertex. The method may further include aligning a main reflector at Block 54, which has a concave surface, with the subreflector to define an offset antenna focal point at the vertex of the subreflector. The method ends at Block 56.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that other modifications and embodiments are intended to be included within the scope of the appended claims.

That which is claimed is:

1. An antenna system comprising:

an antenna feed;

a subreflector aligned with said antenna feed and having a concave surface defining a vertex; and a main reflector having a concave surface and aligned with said subreflector to define an antenna focal area at the vertex of said subreflector.

2. The antenna system according to claim 1 wherein said antenna feed comprises an array antenna feed.

3. The antenna system according to claim 2 wherein said array antenna feed is in the form of a phased array; and further comprising a controller cooperating with said phased array antenna feed for beamsteering.

4. The antenna system according to claim 3 wherein said controller further cooperates with said phased array antenna feed to define and steer multiple beams.

5. The antenna system according to claim 3 wherein said controller further cooperates with said phased array antenna feed to define and steer multiple beams at different frequencies.

6. The antenna system according to claim 2 wherein said array antenna feed is in the form of a fixed array; and further comprising a controller cooperating with said fixed array antenna feed for beamforming.

7. The antenna system according to claim 1 wherein the concave surface of said subreflector has a parabolic shape.

8. The antenna system according to claim 1 wherein the concave surface of said main reflector has a parabolic shape.

9. The antenna system according to claim 1 wherein the concave surface of said subreflector has a partial cylindrical shape.

10. The antenna system according to claim 1 wherein the concave surface of said main reflector has a partial cylindrical shape.

11. The antenna system according to claim 1 wherein said main reflector and subreflector are aligned to define an offset antenna focal area.

12. The antenna system according to claim 1 wherein said main reflector and subreflector are aligned to define at least one of a center fed antenna focal area and an offset center fed antenna focal area.

13. An antenna system comprising:

a controller;

a phased array antenna feed connected to said controller;

a subreflector aligned with said phased array antenna feed and having a concave surf ace defining a vertex; and a main reflector having a concave surface and aligned with said subreflector to define an antenna focal area at the vertex of said subreflector.

14. The antenna system according to claim 13 wherein said controller cooperates with said phased array antenna feed for beamsteering.

15. The antenna system according to claim 14 wherein said controller further cooperates with said phased array antenna feed to define and steer multiple beams.

16. The antenna system according to claim 14 wherein said controller further cooperates with said phased array antenna feed to define and steer multiple beams at different frequencies.

17. The antenna system according to claim 16 wherein said main reflector and subreflector are aligned to define an offset antenna focal area.

18. The antenna system according to claim 16 wherein said main reflector and subreflector are aligned to define at least one of a center fed antenna focal area and an offset center fed antenna focal area.

19. The antenna system according to claim 13 wherein the concave surface of said subreflector has a parabolic shape; and wherein the concave surface of said main reflector has a parabolic shape.

20. The antenna system according to claim 13 wherein the concave surface of said subreflector has a partial cylindrical shape; wherein the concave surface of said main reflector has a partial cylindrical shape.

21. A spacecraft comprising:

a space-borne platform and an antenna system carried thereby, said antenna system comprising an antenna feed, a subreflector aligned with said antenna feed and having a concave surface defining a vertex, and a main reflector having a concave surface and aligned with said subreflector to define an antenna focal area at the vertex of said subreflector.

22. The spacecraft according to claim 21 wherein said antenna feed comprises a phased array antenna feed.

23. The spacecraft according to claim 22 further comprising a controller cooperating with said phased array antenna feed for beamsteering.

24. The spacecraft according to claim 23 wherein said controller further cooperates with said phased array antenna feed to define and steer multiple beams.

25. A method for making an antenna system comprising:

aligning a subreflector with an antenna feed the subreflector having a concave surface defining a vertex; and aligning a main reflector having a concave surface and with the subreflector to define an antenna focal area at the vertex of the subreflector.

26. The method according to claim 25 wherein the antenna feed comprises a phased array antenna feed.

27. The method according to claim 26 further comprising beamsteering using a controller cooperating with the phased array antenna feed.

28. The method according to claim 27 further comprising using the controller in cooperation with the phased array antenna feed to define and steer multiple beams.

* * * * *

UNITED STATES PATENT AND TRADEMARK OFFICE

CERTIFICATE OF CORRECTION

PATENT NO. : 7,205,949 B2
APPLICATION NO. : 11/140836
DATED : April 17, 2007
INVENTOR(S) : Turner It is certified that error appears in the above-identified patent and that said Letters Patent is hereby corrected as shown below:

| | |
|---|---|
| Column 4, Line 8 | Delete: "is in"<br>Insert -- in -- |
| Column 6, Line 2 | Delete: "sur face"<br>Insert --surface -- |

Signed and Sealed this

Fourteenth Day of August, 2007

JON W. DUDAS
*Director of the United States Patent and Trademark Office*